US005635048A

United States Patent [19]

Lu et al.

[11] Patent Number: 5,635,048

[45] Date of Patent: Jun. 3, 1997

[54] METHOD FOR FORMING LOW-ENERGY ELECTRON EXCITED FLUORESCENT SCREEN

[75] Inventors: Jin-Yuh Lu, Taipei; Jyh-Haur Tyan, Hsinchu; David N. Liu, Chutung, all of Taiwan

[73] Assignee: Industrial Technology Research Institute, Hsinchu, Taiwan

[21] Appl. No.: 603,144

[22] Filed: Feb. 20, 1996

[51] Int. Cl.[6] ..... C25D 13/02

[52] U.S. Cl. ..... 204/491; 204/490

[58] Field of Search ..... 204/490, 491

[56] References Cited

U.S. PATENT DOCUMENTS

| | | | |
|---|---|---|---|
| 2,851,408 | 9/1958 | Cerulli | 204/181 |
| 3,681,223 | 8/1972 | Gupton | 204/491 |
| 3,714,011 | 1/1973 | Grosso et al. | 204/490 |
| 4,081,398 | 3/1978 | Hase et al. | 252/301.4 |
| 4,208,613 | 6/1980 | Hase et al. | 313/495 |
| 4,246,086 | 1/1981 | Hennicke et al. | 204/181 |
| 4,992,205 | 2/1991 | Bryan et al. | 252/301.4 |
| 5,009,808 | 4/1991 | Reilly et al. | 252/301.6 |
| 5,017,275 | 5/1991 | Niksa et al. | 204/206 |
| 5,032,316 | 7/1991 | Takahashi et al. | 252/301.6 |
| 5,055,227 | 10/1991 | Yoneshima et al. | 252/301.6 |
| 5,102,579 | 4/1992 | Inaho et al. | 252/301.4 |
| 5,273,774 | 12/1993 | Karam et al. | 427/64 |
| 5,309,071 | 5/1994 | Karam et al. | 313/509 |

OTHER PUBLICATIONS

Shane et al, "Electrophorethic Phosphor Deposition Forcers" SID '93 Digest, pp. 542–545. (*No Month Available).

Siracuse et al, "The Adhesvie Agent in Cataphoretically Coated Phosphor Screens" 137 J. Electrochem. Soc, No. 1, pp. 346–348 (Jan. 1990).

*Primary Examiner*—Kathryn L. Gorgos
*Assistant Examiner*—Kishor Mayekar
*Attorney, Agent, or Firm*—George O. Saile; Alek P. Szecsy

[57] ABSTRACT

A method for forming a low-energy electron excited fluorescent screen. First, there is dissolved in a non-aqueous solvent a charging material. The charging material when dissolved forms a cation which is susceptible to forming an oxide, which oxide is a first essential component of a low-energy electron excited fluorescent phosphor composition. In addition to the charging material, there is suspended in the non-aqueous solvent a phosphor which naturally adopts a positive charge in the non-aqueous solvent. The phosphor is a second essential component of the low-energy electron excited fluorescent phosphor composition. There is then electrophoretically deposited from the non-aqueous solvent the cation and the phosphor to form a low-energy electron excited fluorescent phosphor precursor composition. The electrophoretic deposition occurs upon a fluorescent screen substrate which serves as a cathode. Finally, the low-energy electron excited fluorescent phosphor precursor composition is dried to form a low-energy electron excited fluorescent phosphor composition upon the fluorescent screen substrate.

23 Claims, 2 Drawing Sheets

METHOD FOR FORMING LOW-ENERGY ELECTRON EXCITED FLUORESCENT SCREEN

BACKGROUND OF THE INVENTION

1. Field of the Invention

The present invention relates generally to methods and materials by which fluorescent display screens are manufactured. More particularly, the present invention relates to methods for forming low energy electron excited fluorescent phosphor compositions upon fluorescent display screen substrates, which fluorescent phosphor compositions provide fluorescent display screens having decreased threshold voltages.

2. Description of Related Art

The use of phosphors as fluorescent elements in the production of low-energy (ie: low velocity) electron excited fluorescent screens has been known for many years. The traditionally phosphor employed in fabricating low-energy electron excited fluorescent screens is the zinc activated zinc oxide (ZnO:Zn) phosphor. Although many other phosphors traditionally have been known, the zinc activated zinc oxide (ZnO:Zn) phosphor was unique among traditional phosphors in its ability to fluoresce under low-energy electron excitation conditions, typically at accelerating potentials of less than 100 volts. While many other phosphors fluoresced, they did so only under substantially higher electron excitation conditions, typically in the range of kilo-volts. The low-energy electron excited zinc activated zinc oxide (ZnO:Zn) phosphor fluoresced to produce a green-white image, and the phosphor was used as the active fluorescing element in various types of low-energy electron excited fluorescent display screens for electronic calculators and measuring devices.

As demand for low-energy electron excited fluorescent screens of various color types and increased color purity developed, so also were developed different classes of fluorescent phosphor compositions which met those demands. A large group of such compositions is disclosed by Hase et al., in U.S. Pat. No. 4,081,398 and U.S. Pat. No. 4,208,613. The disclosed compositions include traditional high-energy electron excited fluorescing phosphors mechanically mixed with indium oxide. Although not entirely well understood, it is felt that the improved fluorescence efficiencies of the phosphor/indium oxide fluorescent phosphor compositions derives from the increased electrical conductivity of the phosphor/indium oxide fluorescent phosphor compositions as a whole. With increased electrical conductivity of the fluorescent phosphor compositions, charge up of the phosphors within those compositions does not occur on occasion of low-energy electron excitation of those phosphors.

The low-energy electron excited fluorescent phosphor compositions disclosed by Hase et al. are employed in producing low-energy electron excited fluorescent screens of high color purity in color hues including red, blue and green. Methods through which fluorescent phosphor screens are prepared through these fluorescent phosphor compositions include sedimentation of an aqueous suspension of the phosphor/indium oxide fluorescent phosphor composition onto a fluorescent screen substrate, with subsequent thermal drying.

Subsequent to the Hase et al. disclosure, various additional fluorescent phosphor compositions exhibiting unique or enhanced properties have been disclosed. Methods through which these additional compositions have been formed include: (1) doping of traditional phosphors with metals such as aluminum, copper and zinc; (2) additional mixing of traditional phosphors with conductive oxides such as indium oxide and tungsten oxide; and (3) thin-film processing of traditional phosphors onto surfaces of electrically active particles. Some compositions are susceptible to low-energy electron excitation, other compositions are not. For example, Bryan et al., in U.S. Pat. No. 4,992,205 disclose indium doped and titanium activated fluorescent phosphor compositions used in long-wavelength emitting intensifying screens for x-ray exposure applications. In addition, Reilly et al., in U.S. Pat. No. 5,009,808 describe a method for producing an electro-luminescent zinc sulfide phosphor activated with manganese, chloride and copper. Further, Takahashi et al., in U.S. Pat. No. 5,032,316 describe a uniform high luminescence stability zinc oxide activated zinc-cadmium sulfide fluorescent phosphor composition containing alumina.

Still further, Yoneshima et at., in U.S. Pat. No. 5,055,227 disclose high luminescence low energy electron excited fluorescent phosphor compositions formed through mixture of traditional phosphors with indium oxide of specific crystallinity levels. Yet further, Inaho et al., in U.S. Pat. No. 5,102,579 describe a novel method for decomposing a metal sulfide and thereby forming a sulfurizing atmosphere within which are formed sulfide phosphors. Finally, Karam, et al., in U.S. Pat. Nos. 5,273,774 and 5,309,371 describe a zinc sulfide electro-luminescent phosphor of high luminescent intensity formed through a thin-film process.

In addition to the above recited art which is primarily directed towards the chemical compositions of fluorescent phosphor compositions, there also exists additional art relating to methods by which fluorescent phosphor compositions may be coated upon suitable substrates to form fluorescent screens. Typical coating methods include sedimentation, centrifugation and electrophoresis. For reasons of manufacturing efficiency and reproducibility, electrophoretic methods are often preferred.

Electrophoresis and related electroplating methods are disclosed by Hennicke et al., in U.S. Pat. No. 4,246,086 and Niksa et al., in U.S. Pat. No. 5,017,275. Electrophoretic deposition of luminescent materials has been known for several years, as disclosed by Cerulli in U.S. Pat. No. 2,851,408.

Most pertinent to the present invention, however, are the disclosure of Shane et at., "Electrophoretic Phosphor Deposition for CRTs," SID 93 Digest, pp. 542–45 and the disclosure of Siracuse et al., "The Adhesive Agent in Cataphoretically Coated Phosphor Screens," 137 J. Electrochem. Soc., No. 1, 346–48 (1990). Both of these disclosures address the chemical mechanisms through which alcoholic solutions of magnesium nitrate into which is suspended a fluorescent phosphor composition form upon suitable substrates a fluorescent screen derived from the fluorescent phosphor cemented upon the substrate within a magnesium hydroxide binder.

Desirable in the art are methods which simultaneously exploit a knowledge of the materials through which are formed low-energy electron excited fluorescent phosphor compositions and a knowledge of the methods by which are formed fluorescent screens upon fluorescent screen substrates through coating those fluorescent screen substrates with low-energy electron excited fluorescent phosphor compositions. Through a knowledge of both the low-energy electron excited fluorescent phosphor compositions and methods by which those fluorescent phosphor compositions may be coated to form low-energy electron excited fluorescent screens, there may be formed more efficient low-energy electron excited fluorescent screens with reduced threshold voltages. The foregoing represents the object towards which the present invention is directed.

SUMMARY OF THE INVENTION

A first object of the present invention is to provide a method for forming a low-energy electron excited fluorescent screen having a decreased threshold voltage in comparison with low-energy electron excited fluorescent screens conventional to the art.

A second object of the present invention is to provide a method in accord with the first object of the present invention, which method is also manufacturable.

A third object of the present invention is to provide a method in accord with the first object of the present invention and the second object of the present invention, which method is also economical.

In accord with the objects of the present invention, a new method for forming a low-energy electron excited fluorescent screen is disclosed. To form the low-energy electron excited fluorescent screen in accord with the new method, there is first dissolved in a non-aqueous solvent a charging material. The charging material when dissolved forms a cation which is susceptible to forming an oxide, which oxide is a first essential component of a low-energy electron excited fluorescent phosphor composition. In addition to the charging material, there is suspended in the non-aqueous solvent a phosphor which naturally adopts a positive charge in the non-aqueous solvent. The phosphor is a second essential component of the low energy electron excited fluorescent phosphor composition. There is then electrophoretically deposited from the non-aqueous solvent the cation and the phosphor to form a low-energy electron excited fluorescent phosphor precursor composition. The electrophoretic deposition occurs upon a fluorescent screen substrate which serves as a cathode. Finally, the low-energy electron excited fluorescent phosphor precursor composition is dried to form a low-energy electron excited fluorescent phosphor composition upon the fluorescent screen substrate. The low-energy electron excited fluorescent phosphor composition upon the fluorescent screen substrate forms the a low-energy electron excited fluorescent screen.

The low-energy electron excited fluorescent screen of the present invention has a decreased threshold voltage in comparison with low-energy electron excited fluorescent screens formed through methods conventional to the art. Although the mechanism by which the method of the present invention provides low-energy electron excited fluorescent screens of improved properties is not entirely well understood, it is nonetheless clear that in comparison with fluorescent screens formed through conventional methods, which conventional methods employ conventional charging materials, fluorescent screens formed through the method of the present invention have been experimentally observed to have decreased threshold voltages. It is felt that the charging material through which is formed the fluorescent phosphor precursor composition of the present invention provides an overall higher level of conductivity, when dried, to the fluorescent phosphor composition of the present invention. Through this presumed higher level of conductivity there is a lower level of phosphor charge up under low-energy electron excitation and thus a decrease in phosphor threshold voltage.

The method of the present invention is particularly efficient in providing fluorescent screens with decreased threshold voltages, since the method of the present invention provides a charging material which integrally forms a first essential component of a low-energy electron excited fluorescent phosphor composition. In addition, in comparison with conventional methods for forming low-energy electron excited fluorescent screens, which methods employ a fluorescent phosphor composition which is formed completely external to the fluorescent screen substrate upon which the fluorescent phosphor composition is coated, the method of the present invention provides a fluorescent phosphor precursor composition which is formed in-situ upon a fluorescent screen substrate and subsequently dried to form in-situ a fluorescent phosphor composition upon the fluorescent screen substrate. Through this method there is produced a fluorescent screen with decreased threshold voltage.

The method of the present invention is readily manufacturable. In comparison with conventional electrophoretic methods for manufacturing fluorescent screens, the method of the present invention requires only a substitution of the conventional charging material with a charging material in accord with the present invention. The charging material in accord with the present invention forms a cation, which cation in turn forms an oxide which is an essential component of a fluorescent phosphor composition. Charging materials in accord with the present invention are not difficult to define. They are readily available commercially and provide for a readily manufacturable method.

The method of the present invention is economical. The method of the present invention provides a fluorescent phosphor precursor composition that is formed in-situ upon a fluorescent screen substrate. In addition, one component of the fluorescent phosphor precursor composition is derived from the same material which serves as the charging material for assisting in electrophoretically depositing that fluorescent phosphor precursor composition upon the fluorescent screen substrate. Thus, through the method of the present invention, it is not necessary to independently form a fluorescent phosphor composition and deposit that fluorescent phosphor composition upon a fluorescent screen substrate. Therefore, the method of the present invention is economical in terms of materials cost, materials usage and materials processing time.

BRIEF DESCRIPTION OF THE DRAWINGS

The accompanying drawings, which form a material part of this disclosure, show the following.

DESCRIPTION OF THE PREFERRED EMBODIMENTS

The present invention provides an improved method for forming a low-energy electron excited fluorescent screen through electrophoretic deposition of a low-energy electron excited fluorescent phosphor precursor composition upon a fluorescent screen substrate. The low-energy electron excited fluorescent phosphor precursor composition is subsequently dried to form a low-energy electron excited fluorescent phosphor upon the fluorescent screen substrate. In comparison with conventional methods wherein low-energy electron excited fluorescent phosphor compositions are formed external to a fluorescent screen substrate and subsequently coated upon that fluorescent screen substrate to form a fluorescent screen, the method of the present invention provides a fluorescent screen that is formed by electrophoretically depositing in-situ a low-energy electron excited fluorescent phosphor precursor composition upon a fluorescent screen substrate. Upon drying the low-energy electron excited fluorescent phosphor precursor composition, there is formed in-situ a low-energy electron excited fluorescent phosphor composition upon a fluorescent screen substrate.

The method of the present invention may be employed in manufacturing any low-energy electron excited fluorescent screen formed from deposition of a low-energy electron excited fluorescent phosphor composition upon a fluorescent screen substrate wherein the low-energy electron excited fluorescent phosphor composition is: (1) formed from a phosphor which naturally adopts a positive charge in the non-aqueous solvent within which the electrophoretic method of the present invention is undertaken, and (2) formed with an oxide material which may be derived from a cation which in turn may be derived from a charging material dissolved in the non-aqueous solvent within which the electrophoretic method of the present invention is undertaken.

Figure 1A:
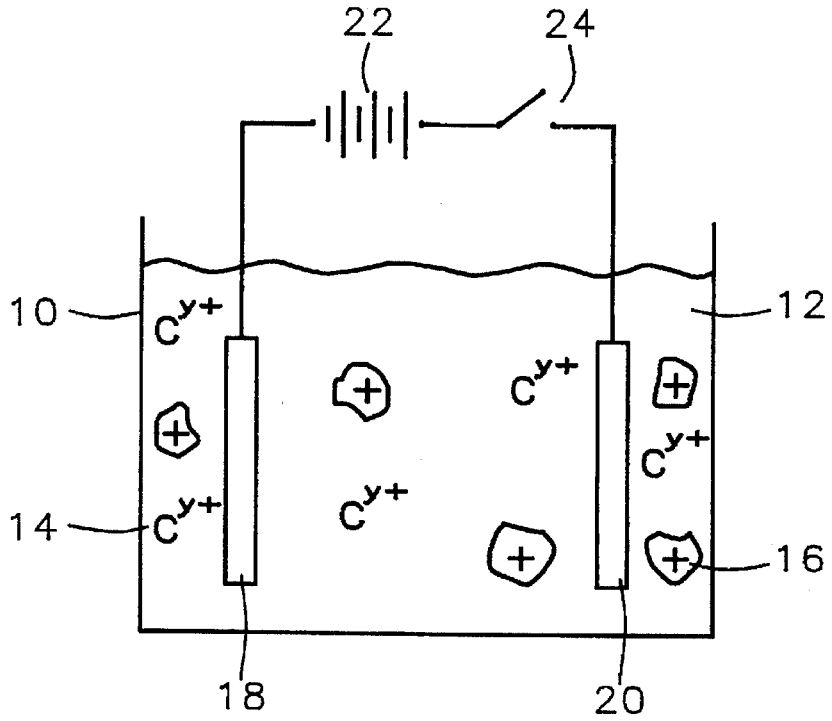
FIG. 1*a* and FIG. 1*b* show a schematic diagram of an electrophoresis cell at progressive stages of practice of the preferred embodiment of the present invention.

Referring now to FIG. 1*a* there is shown a schematic diagram of the apparatus through which is undertaken the method of the present invention. Shown in FIG. 1*a* is an electrophoresis cell 10 within which there resides a non-aqueous solvent 12. Electrophoresis cells and non-aqueous solvents within which electrophoretic deposition reactions may be undertaken within electrophoresis cells are known in the art. Such solvents are typically polar non-aqueous solvents which allow for adequate dissociation and charge polarization of species to be deposited from those polar non-aqueous solvents through electrophoretic deposition reactions. Thus, such solvents include, but are not limited to alcohols and acetone. For the preferred embodiment of the present invention, the non-aqueous solvent 12 may be chosen from the group of polar non-aqueous solvents consisting of alcohols and acetone. Most preferred are the alcohols ethanol, propanol and iso-propanol.

It is highly desirable to the present invention that the non-aqueous solvent within which is practiced the method of the present invention has dissolved therein a hydroxyl ion forming specie. The hydroxyl ion forming specie may come from the solvent itself, such as hydroxyl ions which are formed from polar non-aqueous alcohol solvents, or the hydroxyl ion forming specie may be formed from a minor component of water preferably added to the non-aqueous solvent at about 0.1 to about 2.0 percent by weight. The presence of the hydroxyl ion forming specie facilitates the formation of intermediate species which lead to the low-energy electron excited fluorescent phosphor composition of the present invention.

Also shown in FIG. 1*a* are cations 14 which are dissolved in the non-aqueous solvent 12 and phosphor particles 16 which are suspended in the non-aqueous solvent 12. Several aspects of the cations 14 and the phosphor particles 16 are critical in forming the low-energy electron excited fluorescent screen of the preferred embodiment of the present invention.

First, it is critical that the cations 14 are cations which are susceptible to forming an oxide, which oxide in turn is a first essential component of a low-energy electron excited fluorescent phosphor composition. The cations 14 are preferably provided to the non-aqueous solvent 12 through decomposition of a charging material which is added to the non-aqueous solvent 12.

There are several oxides which are known in the art to form essential components of fluorescent phosphor compositions. These oxides include but are not limited to indium oxide, tin oxide and zinc oxide. Thus, for the preferred embodiment of the present invention, the cations 14 which are formed through decomposition of the charging material are preferably cations which will form indium oxide, tin oxide or zinc oxide. Most preferably, the cations 14 formed from decomposition of the charging material will be cations which will form an indium oxide or a tin oxide, since these two oxides are most common as essential components in low-energy electron excited fluorescent phosphor compositions.

With regard to the charging material from which is formed the cations, it is preferred that the charging material be a simple salt of the cation. The anion which forms the simple salt with the cation may be any anion which provides sufficient dissociation of the charging agent to yield adequate quantities of the cation in the non-aqueous solvent. Nitrate and chloride salts are common and preferred; other salts may be employed. For the most preferred embodiment of the present invention, the charging materials are indium chloride ($InCl_3$), tin (II) chloride ($SnCl_2$) and tin (IV) chloride ($SnCl_4$).

Next, it is critical that the phosphor particles 16 which are suspended in the non-aqueous solvent 12 naturally adopt a positive charge in the non-aqueous solvent 12. Although this is a critical requirement for the present invention, it is not necessarily an inherent requirement of the phosphor particles 16. It is known in the art that varying levels and polarity of charge of a particle in a non-aqueous solvent may often be provided through judicious choice of additive electrolyte species to the non-aqueous solvent. See, for example, M. J. Shane et al., "Electrophoretic Phosphor Deposition for CRTs," SID 93 Digest, pg. 543 (FIG. 3 and accompanying text). Given the flexibility with which a positive charge may be provided to phosphor particles in a non-aqueous medium, the present invention may be undertaken employing a broad range of types of phosphor particles, including but not limited to zinc oxide phosphor particles, zinc cadmium sulfide phosphor particles, rare earth phosphor particles and zinc gallate phosphor particles. The preceding group of phosphor particles represents the group of phosphor particles from which the phosphor particles 16 of the preferred embodiment are preferably chosen. Most preferred are zinc oxide phosphor particles and zinc cadmium sulfide phosphor particles which are most common in the art. Preferably the size of the phosphor particles 16 suspended in the non-aqueous solvent is about 1 to about 10 microns in diameter. Preferably, the weight ratio of the charging material from which is formed the cations 14 to the phosphor from which is formed the phosphor particles 16 is from about 1:40 to about 1:400. Finally, the concentration of the phosphor in the non-aqueous solvent is preferably from about 1 to about 4 milligrams per cubic centimeter (mg/cc).

Finally, there is also shown in FIG. 1*a* an anode 18 which is connected to a cathode 20 through an electrochemical potential source 22 in series with a switch 24. The switch 24 is illustrated as open in FIG. 1*a*.

The anode 18 is not a critical element in forming the low-energy electron excited fluorescent screen of the preferred embodiment of the present invention. The anode 18 may be formed of any material from which anodes within electrophoresis cells are conventionally formed, given the proviso that the anode 18 neither reacts with the non-aqueous solvent 12 nor corrodes through electrochemical oxidation with the non-aqueous solvent 12 at the electrophoresis potential at which the electrophoresis cell of the present invention is operated. Many anode materials fulfill these requirements. Although other anode materials may be employed, the anode 18 is preferably formed of stainless steel as is common in the art.

The cathode 20 is a critical element in forming the low-energy electron excited fluorescent screen of the present invention, since the cathode 20 forms the fluorescent screen substrate from which the low energy electron excited fluorescent screen of the present invention is formed. Therefore, the cathode 20 is typically and preferably formed from a glass material having high optical transparency. Any of several types of glass materials which are known in the art to possess a high optical transparency may be employed in forming the cathode 20. Glasses including but not limited to silicate glass, Boro Silicate Glass (BSG), Phospho Silicate Glass (PSG) and Boro Phospho Silicate Glass (BPSG) may be employed in forming the cathode 20 which forms the fluorescent screen substrate of the low energy electron excited fluorescent screen of the preferred embodiment of the present invention.

In general, in order for a cathode which is formed from a glass material having high optical transparency to serve adequately as a cathode within an electrophoresis cell, the glass material must have a conductive coating formed upon at least one of its surfaces, preferably a surface opposite to the anode within the same electrophoresis cell. There are several methods and materials through which a cathode formed from a glass material may have formed upon at least one of its surfaces a conductive coating. Such methods include but are not limited to Chemical Vapor Deposition (CVD) and Physical Vapor Deposition (PVD) methods whereby conductive materials such as conductive metals and conductive metal oxides may be formed upon at least one of the surfaces of the cathode. For the preferred embodiment of the present invention, the cathode 20 is preferably formed of an optically transparent glass upon one side of which is formed a conductive oxide formed of Indium Tin Oxide (ITO). The Indium Tin Oxide (ITO) conductive coating is well known in the art as a highly conductive coating which has a high optical transparency. Other conductive coatings may be employed, typically with significant reductions in optical transparency of the glass from which is formed the cathode 20. Although not specifically illustrated in FIG. 1*a*, the surface of the cathode 20 upon which is formed the Indium Tin Oxide (ITO) coating is preferably the surface of the cathode 20 directly opposite the anode Referring now to FIG. 1*b*, there is shown the results obtained by completing the electrical circuit between the anode 18 and the cathode 20 illustrated in FIG. 1*a*, by means of closing the switch 24. When the switch 24 is closed, a positive charge is imposed upon the anode 18 from the electrochemical potential source 22, and a negative charge is imposed upon the cathode 20 from the electrochemical potential source 22. Although not specifically illustrated in FIG. 1*b*, the negative charge upon the cathode 20 will localize upon that surface of the cathode 20 which has formed thereupon the conductive coating. Preferably, that surface will be the surface of the cathode 20 directly opposite the anode 18.

Figure 1B:
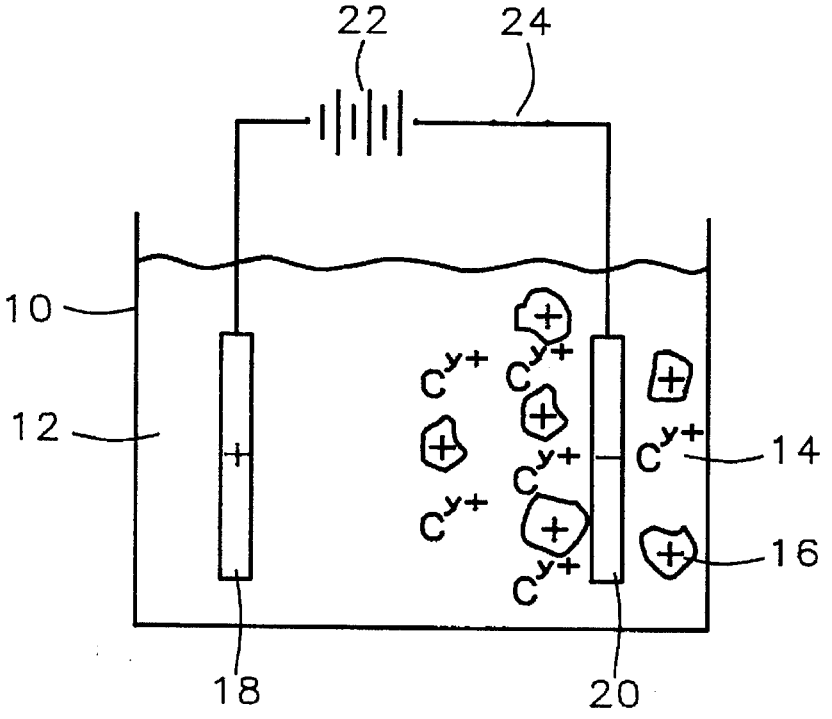

Upon completing the electrical circuit between the cathode 20 and the anode 18, the electrical potential between the anode 18 and the cathode 20 creates an electrical field between the cathode 20 and the anode 18, which electrical field causes the cations 14 and the phosphor particles 16 to polarize and migrate towards the surface of cathode 20 which is coated with the conductive coating. As illustrated in FIG. 1*b*, the cations 14 and the phosphor particles 16 will arrange themselves in a minimum of one layer adjoining the conductive coating. The concentration of cations 14 and phosphor particles 16 which will polarize at the surface of the conductive coating on the cathode 20 will be defined by several factors, including but not limited to the concentrations of the cations 14 and the phosphor particles 16 in the non-aqueous solvent 12, the mobilities of the cations 14 and the phosphor particles 16 in the non-aqueous solvent 12, the design parameters of the electrophoresis cell 10, the geometries of the anode 18 and the cathode 20, and the magnitude of the applied electrochemical potential from the electrochemical potential source 22. Preferably, the applied electrochemical potential from the electrochemical potential source 22 will be from about 50 to about 600 volts.

Upon reaching the cathode 20, an electrochemical reaction occurs whereby the cations 14 and the phosphor particles 16 react with the surface of the conductive coating upon the cathode 20 to form a fluorescent phosphor precursor composition upon the surface of the cathode 20. Although the exact nature of the fluorescent phosphor precursor composition is not known with certainty, it is believed that the composition of the fluorescent phosphor precursor composition is a hydroxide or hydrated oxide of the cations 14 in conjunction with phosphor particles 16 which have surrendered their positive charges upon reaching the cathode 20.

Figure 2A:
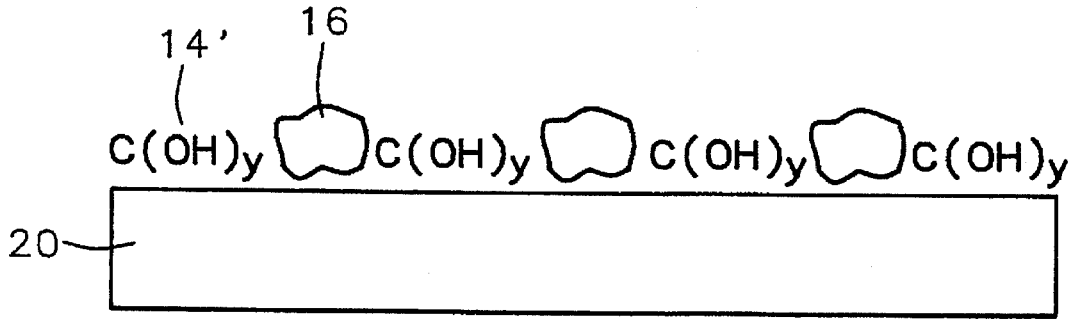
FIG. 2*a* and FIG. 2*b* show a fluorescent screen substrate at progressive stages of formation thereupon of the low-energy electron excited fluorescent phosphor composition of the preferred embodiment of the present invention.

A schematic cross-sectional diagram of the cathode 20 at this point in the electrophoresis process is shown in FIG. 2*a*. FIG. 2*a* illustrates the cathode 20 upon whose surface is formed the fluorescent phosphor precursor composition which is comprised of the phosphor particles 16 which are adjoined by a cationic hydroxide/hydrated oxide 14'. Preferably, the fluorescent phosphor precursor composition is from about several tens of angstroms to about several hundreds of angstroms thick upon the surface of the cathode 20. Typically, the fluorescent phosphor precursor composition will reach this thickness within an electrophoresis time of several minutes at an electrochemical potential of about 50 to about 600 volts. Upon reaching this thickness, the switch 24 is opened.

Figure 2B:
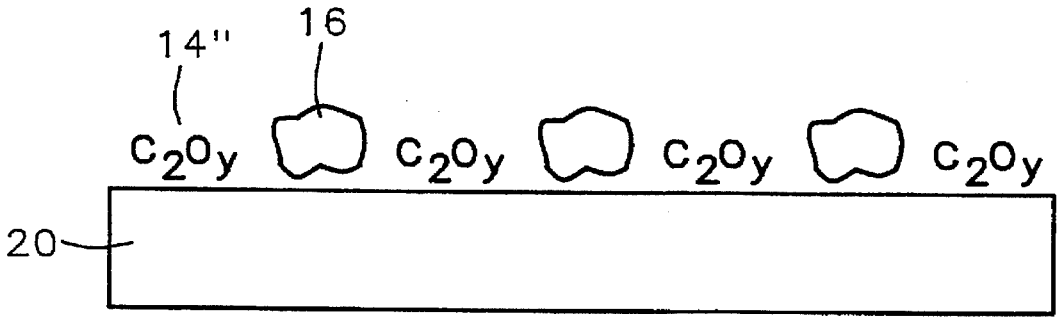

Referring now to FIG. 2*b*, there is shown the cathode 20 at the last stages in processing of the preferred embodiment of the present invention. Shown in FIG. 2*b* is the cathode 20 upon which the cationic hydroxide/hydrated oxide 14' has been dehydrated to form the oxide 14". Through the dehydration process, the phosphor particles 16 remain largely unchanged but they are now cemented in place upon the surface of the conductive coating through means of the oxide 14". Together, the oxide 14" and the phosphor particles 16 form the low-energy electron excited fluorescent phosphor composition of the present invention.

Several methods may be employed to perform the dehydration process through which an oxide 14' of chemical structure approximate to that of FIG. 2*b* may be obtained. Such dehydration methods include but not limited to thermal dehydration methods and Infra-Red (IR) radiation dehydration methods. For the preferred embodiment of the present invention, the cationic hydroxide/hydrated oxide 14' is preferably dehydrated to form the oxide 14" through a thermal dehydration process at a temperature of about 300 to about 500 degrees centigrade for a time period of about 60 to about 180 minutes.

Upon dehydrating the cationic hydroxide/hydrated oxide 14' to form the oxide 14" which cements the phosphor particles 16 upon the conductive coating, which conductive coating in turn resides upon the cathode 20, there is formed the fluorescent screen of the preferred embodiment of the present invention. The fluorescent screen of the preferred embodiment of the present invention may be incorporated, through methods as are known in the art, into electronic displays including but not limited to video displays and digital data displays, which displays are known in the art. The fluorescent screen of the preferred embodiment of the present invention has a lower threshold voltage than fluorescent screens formed through electrophoretic processes wherein a fluorescent phosphor composition is not formed in-situ upon a fluorescent screen substrate. Due to this lower threshold voltage, the fluorescent screen of the preferred embodiment of the present invention also has a higher luminous efficiency.

The present invention will now be illustrated with greater particularity through the following examples.

EXAMPLE 1

Into an electrophoretic cell was placed about 100 ml of the non-aqueous solvent isopropyl alcohol which contained about 1 percent water. Dissolved in the non-aqueous solvent isopropyl alcohol was about 0.001 grams of magnesium nitrate charging material. Suspended in the non-aqueous solvent isopropyl alcohol was about 0.4 grams of a zinc activated zinc oxide (ZnO:Zn) phosphor. Placed into the non-aqueous solvent isopropyl alcohol was a stainless steel anode and a cathode, the cathode being formed of a Boro Silicate Glass (BAG) plate of surface area of about 50 square centimeters and thickness of about 0.1 centimeters. The Boro Silicate Glass (BSG) cathode formed a fluorescent screen substrate. Upon one side of the Boro Silicate Glass (BSG) cathode was formed an Indium Tin Oxide (ITO) coating of about 1000 angstroms thickness.

The anode and the cathode were connected to an electrochemical potential source at a potential of about 200 volts for a time period of about 30 seconds. After the electrophoresis treatment, the cathode was rinsed in deionized water and subsequently thermally dehydrated at a temperature of about 450 degrees centigrade for a time period of about 180 minutes to yield a fluorescent phosphor composition upon the fluorescent screen substrate, thus comprising a fluorescent screen. The threshold voltage (Vt) of the fluorescent screen which was formed from the fluorescent phosphor composition upon the fluorescent screen substrate was measured through methods as are conventional in the art. The threshold voltage (Vt) so determined is reported in TABLE I.

EXAMPLE 2

A second fluorescent screen was prepared in accord with the methods and materials outlined for forming the fluorescent screen in EXAMPLE 1 with the exception that the magnesium nitrate charging material of EXAMPLE 1 was replaced with an equivalent weight of indium chloride charging material. The threshold voltage (Vt) of the second fluorescent screen was also determined through methods as are conventional in the art. The threshold voltage (Vt) so determined is also reported in TABLE I.

EXAMPLE 3

A third fluorescent screen was prepared in accord with the method and materials outlined for forming the fluorescent screen of EXAMPLE 1 with the exception that the zinc activated zinc oxide (ZnO:Zn) phosphor of EXAMPLE 1 was replaced with an equivalent weight of a silver and chlorine activated zinc-cadmium sulfide phosphor/indium oxide fluorescent phosphor composition ((Zn,Cd)S:Ag,Cl/In203). The weight ratio of the silver and chlorine activated zinc-cadmium sulfide phosphor to the indium oxide was about 5:1. The threshold voltage (Vt) of the third fluorescent screen was also determined through methods as are conventional in the art. The threshold voltage (Vt) so determined is also reported in TABLE I.

EXAMPLE 4

A fourth fluorescent screen was prepared in accord with the method outlined for preparing the fluorescent screen of EXAMPLE 1 with the exception that the magnesium nitrate charging material of EXAMPLE 1 was replaced with an equivalent weight of indium chloride charging material, and the zinc activated zinc oxide (ZnO:Zn) phosphor of EXAMPLE 1 was replaced with a weight of a silver and chlorine activated zinc-cadmium sulfide ((Zn,Cd)S:Ag,Cl) phosphor equivalent to the weight of silver and chlorine activated zinc-cadmium sulfide ((Zn,Cd)S:Ag,Cl) phosphor employed in EXAMPLE 3. The threshold voltage (Vt) of the fourth fluorescent screen was determined through the methods as are conventional in the art. The threshold voltage (Vt) so determined is reported in TABLE I.

TABLE I

| Example | Phosphor | Charg. Matl. | Vt(V) |
|---|---|---|---|
| 1 | ZnO:Zn | Mg(NO3)2 | 70 |
| 2 | ZnO:Zn | InCl3 | 50 |
| 3 | (Zn,Cd)S:Ag,Cl/In2O3 | Mg(NO3)2 | 120 |
| 4 | (Zn,Cd)S:Ag,Cl | InCl3 | 90 |

From the data of Example 1 and Example 2 it is seen that the substitution of indium chloride charging material for an equivalent weight of magnesium nitrate charging material, in otherwise equivalent electrophoresis compositions, provides a fluorescent screen formed from a zinc activated zinc oxide (ZnO:Zn) phosphor with a lower threshold voltage (Vt). From the data of Example 3 and Example 4 it is analogously seen that the substitution of indium chloride charging material for both a magnesium nitrate charging material and the indium oxide component of silver and chloride activated zinc-cadmium sulfide ((Zn,Cd)S:Ag,Cl) phosphor provides a fluorescent screen with a lower threshold voltage (Vt).

As is understood by a person skilled in the art, the foregoing description and EXAMPLES are illustrative of the present invention rather than limiting of the present invention. Changes and revisions to methods and materials through which are formed fluorescent screens of the preferred embodiment and EXAMPLES of the present invention may yield additional embodiments which are within the spirit and scope of the present invention.

What is claimed is:

1. A method for forming a fluorescent screen comprising:

dissolving in a non-aqueous solvent a charging material, the charging material being a metal salt comprising a cation which in conjunction with a phosphor forms through an electrochemical reaction an oxide selected from the group of oxides consisting of indium oxides and tin oxides;

suspending in the non-aqueous solvent the phosphor which adopts a positive charge in the non-aqueous solvent;

depositing electrophoretically from the non-aqueous solvent the cation and the phosphor to form a low energy electron excited fluorescent phosphor precursor composition in-situ upon a fluorescent screen substrate as a cathode; and drying the low energy electron excited fluorescent phosphor precursor composition to form a low energy electron excited fluorescent phosphor composition upon the fluorescent screen substrate wherein the low energy electron excited fluorescent phosphor composition has a lower threshold voltage than an analogous low energy electron excited fluorescent phosphor composition formed in absence of the charging material comprising the cation.

2. The method of claim 1 wherein the non-aqueous solvent is chosen from the group of non-aqueous solvents consisting of alcohols and acetone.

3. The method of claim 1 wherein the phosphor is chosen from the group of phosphors consisting of zinc oxide phosphors, zinc cadmium sulfide phosphors, rare earth phosphors and zinc gallate phosphors.

4. The method of claim 1 wherein the charging material to the phosphor is present in a weight ratio from about 1:40 to about 1:400.

5. The method of claim 1 wherein the phosphor in the non-aqueous solvent has a concentration from about 1 to about 4 milligrams per cubic centimeter (mg/cc).

6. The method of claim 1 wherein the low energy electron excited fluorescent phosphor precursor composition is electrophoretically deposited at an electrochemical potential of about 50 to about 600 volts for a time period of about 10 to about 180 seconds.

7. The method of claim 1 wherein the drying is undertaken at a temperature of about 300 to about 500 degrees centigrade for a time period of about 60 to about 180 minutes.

8. The method of claim 1 further comprising adding a hydroxyl ion forming specie in the non-aqueous solvent.

9. The method of claim 10 wherein the hydroxyl ion forming specie is water, the water being added in the non-aqueous solvent at a concentration of about 0.1 to about 2.0 percent.

10. A method for forming a fluorescent screen comprising:

dissolving in a non-aqueous solvent a charging material, the charging material being a metal salt comprising a cation which in conjunction with a phosphor forms through an electrochemical reaction an indium oxide, suspending in the non-aqueous solvent the phosphor which adopts a positive charge in the non-aqueous solvent depositing electrophoretically from the non-aqueous solvent the cation and the phosphor to form a low energy electron excited fluorescent phosphor precursor composition in-situ upon a fluorescent screen substrate as a cathode; and drying the low energy electron excited fluorescent phosphor precursor composition to form a low energy electron excited fluorescent phosphor composition upon the fluorescent screen substrate, wherein the low energy electron excited fluorescent phosphor composition has a lower threshold voltage than an analogous low energy electron excited fluorescent phosphor composition formed in absence of the charging material comprising the cation.

11. The method of claim 10 wherein the non-aqueous solvent is iso-propanol.

12. The method of claim 10 wherein the charging material is indium chloride.

13. The method of claim 10 wherein the phosphor is chosen from the group of phosphors consisting of zinc oxide phosphors, zinc cadmium sulfide phosphors, rare earth phosphors and zinc gallate phosphors.

14. The method of claim 10 wherein the charging material to the phosphor is present in a weight ratio from about 1:40 to about 1:400, and the phosphor in the non-aqueous solvent has a concentration from about 1 to about 4 milligrams per cubic centimeter (mg/cc).

15. The method of claim 10 wherein the low energy electron excited fluorescent phosphor precursor composition is electrophoretically deposited at an electrochemical potential of about 50 to about 600 volts for a time period of about 10 to about 180 seconds.

16. The method of claim 10 wherein the drying is undertaken at a temperature of about 300 to about 500 degrees centigrade for a time period of about 60 to about 180 minutes.

17. A method for forming a fluorescent screen comprising:

dissolving in a non-aqueous solvent a charging material, the charging material being a metal salt comprising a cation which in conjunction with a phosphor forms through an electrochemical reaction a tin oxide;

suspending in the non-aqueous solvent the phosphor which adopts a positive charge in the non-aqueous solvent;

depositing electrophoretically from the non-aqueous solvent the cation and the phosphor to form a low energy electron excited fluorescent phosphor precursor composition in-situ upon a fluorescent screen substrate as a cathode; and drying the low energy electron excited fluorescent phosphor precursor composition to form a low energy electron excited fluorescent phosphor composition upon the fluorescent screen substrate wherein the low energy electron excited fluorescent phosphor composition has a lower threshold voltage than an analogous low energy electron excited fluorescent phosphor composition formed in absence of the charging material comprising the cation.

18. The method of claim 17 wherein the non-aqueous solvent is iso-propanol.

19. The method of claim 17 wherein the charging material is tin chloride.

20. The method of claim 17 wherein the phosphor is chosen from the group of phosphors consisting of zinc oxide phosphors, zinc cadmium sulfide phosphors, rare earth phosphors and zinc gallate phosphors.

21. The method of claim 17 wherein the charging material to the phosphor is present in a weight ratio from about 1:40 to about 1:400, and the phosphor in the non-aqueous solvent has a concentration from about 1 to about 4 milligrams per cubic centimeter (mg/cc).

22. The method of claim 17 wherein the low energy electron excited fluorescent phosphor precursor composition is electrophoretically deposited at an electrochemical potential of about 50 to about 600 volts for a time period of about 10 to about 180 seconds.

23. The method of claim 17 wherein the drying is undertaken at a temperature of about 300 to about 500 degrees centigrade for a time period of about 60 to about 180 minutes.

* * * * *